US010845017B2

(12) United States Patent
Renaud et al.

(10) Patent No.: US 10,845,017 B2
(45) Date of Patent: Nov. 24, 2020

(54) LUMINOUS MOTOR-VEHICLE MODULE ABLE TO GENERATE A LIGHT BEAM WITH AT LEAST ONE ROW OF PIXELS

(71) Applicant: VALEO VISION, Bobigny (FR)

(72) Inventors: Pierre Renaud, Bobigny (FR); Alexandre Joerg, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 16/526,493

(22) Filed: Jul. 30, 2019

(65) Prior Publication Data

US 2020/0032973 A1 Jan. 30, 2020

(30) Foreign Application Priority Data

Jul. 30, 2018 (FR) ..... 18 57088

(51) Int. Cl.

| | |
|---|---|
| ***F21V 9/00*** | (2018.01) |
| ***F21S 41/143*** | (2018.01) |
| ***F21S 41/24*** | (2018.01) |
| ***F21S 41/153*** | (2018.01) |
| ***F21S 41/25*** | (2018.01) |
| *F21S 45/48* | (2018.01) |
| *F21W 102/14* | (2018.01) |
| *F21S 41/663* | (2018.01) |

(52) U.S. Cl.

CPC ..... *F21S 41/143* (2018.01); *F21S 41/153* (2018.01); *F21S 41/24* (2018.01); *F21S 41/25* (2018.01); *F21S 41/663* (2018.01); *F21S 45/48* (2018.01); *F21W 2102/14* (2018.01)

(58) Field of Classification Search

CPC ..... F21S 41/663; F21S 41/24

See application file for complete search history.

(56) References Cited

U.S. PATENT DOCUMENTS

| | | | | |
|---|---|---|---|---|
| 2008/0198574 | A1* | 8/2008 | Woodward | F21S 41/143 362/85 |
| 2009/0016074 | A1 | 1/2009 | Dolson et al. | |
| 2014/0198513 | A1 | 7/2014 | Stefanov et al. | |
| 2016/0040848 | A1* | 2/2016 | Tsukamoto | F21S 41/147 362/509 |
| 2018/0087735 | A1 | 3/2018 | Joerg et al. | |

FOREIGN PATENT DOCUMENTS

| | | |
|---|---|---|
| DE | 10 2013 200 442 B3 | 2/2014 |
| EP | 3 301 347 A1 | 4/2018 |
| WO | WO 2018/024349 A1 | 2/2018 |

OTHER PUBLICATIONS

French Preliminary Search Report dated Apr. 3, 2019 in French Application 18 57088 filed on Jul. 30, 2018 (with English translation of categories of cited documents).

* cited by examiner

*Primary Examiner* — Matthew J. Peerce

(74) *Attorney, Agent, or Firm* — Oblon, McClelland, Maier & Neustadt, L.L.P.

(57) ABSTRACT

A luminous motor-vehicle module intended to generate a light beam that projects forward an image. The image comprises at least one horizontal row of pixels. The luminous module is arranged so that a first pixel of the horizontal row of pixels comprises a lower end and/or an upper end that are/is vertically offset with respect to a lower end and/or an upper end of a second pixel of the same row, respectively.

16 Claims, 4 Drawing Sheets

LUMINOUS MOTOR-VEHICLE MODULE ABLE TO GENERATE A LIGHT BEAM WITH AT LEAST ONE ROW OF PIXELS

The invention relates to a luminous motor-vehicle system that is able to produce a light beam that projects forward an image comprising at least one horizontal row of pixels.

Such a light beam is alternatively called a pixelated beam, pixel beam or multibeam.

Generally, these pixels are placed side-by-side in a horizontal row. There may be one or more than one horizontal rows of pixels.

By selectively turning off or turning on each elementary light source, the turned-off or turned-on state of the corresponding pixel is controlled. The beam then consists of a plurality of pixels, which are turned on or turned off depending on the presence of other vehicles in the emission zone.

Thus, the luminous module able to generate such a light beam is often used to complement a luminous module producing a high-beam segment in front lighting devices for producing an adaptive driving beam or ADB.

Specifically, a bottom segment, which may originate from another module, illuminates under the horizon and the turned-on pixels complete the lighting above this bottom segment and the horizon so as to form a long-range beam.

The pixels may thus be turned off so as to create a dark zone in the location in which there is another vehicle, whether followed or oncoming. Therefore, the risk of the driver of the other vehicle being subjected to glare is decreased while good road visibility is preserved by virtue of the pixels that are not turned off.

In another example, the luminous module forming a pixelated light beam may also be used to complement a luminous module forming a low beam, also called a dipped beam, or a bottom low-beam segment. In this configuration, the pixelated light beam may form a dynamic bending light or DBL allowing the light beam to track the curvature of bends followed by the vehicle.

The aforementioned ADB and DBL functions are lighting functions that improves the quality and comfort of the visibility of the lighting device. Lighting devices integrating these functions are therefore increasingly being developed.

Regulations are being changed in step with the development of these lighting devices. The latter must thus meet national and/or regional regulations, in particular of large regulatory groups such as in Europe, in China and in the United States.

For example, a regulated low beam must contain photometric zones the light intensity of which meets values set by regulations.

For example, in Europe, Regulation No 123 of the Economic Commission for Europe of the United Nations exists. This regulation, also called Regulation UNECE R123 for short, relates to provisions concerning the approval of adaptive front-lighting systems for motor vehicles.

The version of Regulation UNECE R123 in force as at 21 Oct. 2013 requires that, for right-hand traffic, the segment located from 8° R to 20° R and 0.57° U from the cut-off line must have an intensity less than or equal to 3550 cd. This segment is also called "segment BRR".

Here, the letters "R" and "U" correspond to abbreviations of the terms "right" and "up", respectively.

In the case of a pixelated light beam contributing to producing a dynamic bending light, generally a row of pixels forming a top portion of a low beam is provided plumb with a horizontal cut-off line in order to produce the DBL function of the final light beam. However, given that each pixel has a height larger than 0.57°, and for example of 0.7° to 1°, at least one pixel of said row superposes with the segment BRR of the base low beam.

Therefore, the pixel delivers additional light intensity to the zone of the segment BRR. This runs the risk of making the light intensity of the segment BRR exceed the regulatory value and therefore of making the lighting device non-compliant.

Zones, such as the segment BRR, the photometric characteristics of which must meet regulations are also called regulated zones.

The technical problem that the invention aims to solve is therefore that of obtaining a pixelated light beam that may be combined with a segment of a second light beam so as to produce a main lighting beam incorporating an adaptive function, such as an ADB or DBL function, while forming a main lighting beam in which the risk of excessive light intensity in certain zones is decreased, and in particular that meets regulations.

To this end, a first subject of the invention is a luminous motor-vehicle module intended to generate a light beam that projects forward an image. Said image comprises at least one horizontal row of pixels.

According to the invention, the luminous module is arranged so that a first pixel of a first horizontal row of pixels comprises a lower end and/or an upper end that are/is offset vertically with respect to a lower end and/or upper end of a second pixel of the same row, respectively. Furthermore, the first horizontal row of pixels forms a top segment of a low beam.

In other words, in the image of the light beam, there is a least one row of pixels forming a top segment of a low beam in which the pixels are not all aligned.

Of course, the offset may be applied to a plurality of pixels of the row. Thus, in the same row, it is possible to offset one or more pixels relative to the other pixels.

The pixels of the row of pixels forming a top segment of a low beam are partially plumb with a horizontal cut-off line and partially offset with respect to this horizontal line.

It is thus possible to arrange the modules so that the one or more offset pixels are those likely to straddle certain regulated zones before being offset. Such an arrangement conflicts with common usage and the prejudice that consists in wanting to exactly align luminous strips and/or the pixels in a row.

In the aforementioned example, the offset pixels are pixels that would cross the segment BRR if the row contained only aligned pixels.

Thus, in the absence of pixel in the location of the segment BRR, there is little risk that the light intensity will exceed the maximum allowed value.

Thus, by virtue of the luminous system according to the invention, the final main lighting beam therefore meets the conditions set by the regulation.

The luminous system according to the invention may optionally have one or more of the following features:

- said first pixel comprises an upper end that is offset downward with respect to an upper end of said second pixel;
- said first pixel comprises a lower end that is offset downward with respect to a lower end of said second pixel;
- said first pixel has a height smaller than the height of said second pixel; this paragraph and the two paragraphs before it describe three different ways of offsetting at least one pixel with respect to the other pixels in the same row; it is possible to decrease the dimension, measured in the vertical direction, or in other words the dimension called height, of the pixel in question; alternatively, the dimension of the pixel in question remains identical to that of the other non-offset pixels, but said pixel is moved vertically downward or upward; finally, it is possible to combine the preceding two methods, i.e. to both decrease the heightwise dimension of the pixel and to move it vertically upward or downward;

the first pixel is located below a horizontal line located at 0.57° U; and the second pixel straddles said horizontal line located at 0.57° U; the luminous module thus decreases the risk that segment BRR will cause glare, and in particular the risk of non-compliance with the aforementioned Regulation UNECE R123;

the first pixel comprises an upper end located at the same level or below a horizontal axis at 0° U and the second pixel straddles said horizontal axis; thus, the luminous module decreases the risk of glare at the horizon in a defined zone in front of the vehicle while increasing range outside of this zone; the module will for example be used to apply FMVSS standard No. 108, which is applicable to the United States; FMVSS is the acronym of "Federal Motor Vehicle Safety Standard;

the image comprises at least one second horizontal row of pixels, said row, which is called the upper horizontal row, being placed above said first horizontal row of pixels;

according to the preceding paragraph, the upper horizontal row of pixels forms a distribution of an adaptive complementary high beam. Thus, when the luminous module is used to complement a luminous module forming a low beam or a bottom low-beam segment, the superposition of the complementary adaptive high beam with the beam emitted by the first row of pixels and with the low beam or with the bottom low-beam segment forms a light with an adaptive high beam;

the luminous module comprises:

a plurality of primary light sources;

an optical element placed downstream of the matrix array of light sources and comprising a plurality of light guides; each guide comprising an entrance face placed facing an associated primary light source and an exit; the exits of the light guides forming secondary light sources;

a projecting assembly placed downstream of the light guides so as to project forward the image of the secondary light sources;

the optical element and the projecting assembly are arranged so that the exit of each light guide is coplanar with a focal plane of the projecting assembly; specifically, the exits of the light guides form a matrix array of secondary light sources; said matrix array is then imaged by the projecting assembly in order to form the final image of the luminous module of the invention; thus, by placing the exits of the light guides in the focal plane of the projecting optic, all the secondary light sources are imaged clearly and the light distribution is uniform;

the optical element comprises a first light guide that participates in the generation of the first pixel, and a second light guide that participates in the generation of the second pixel, the first guide and second guide each comprising an exit, the first exit and the second exit, respectively; the first exit comprises a lower and/or upper edge that are/is offset vertically with respect to a lower and/or upper edge of the second exit, respectively;

the projecting assembly comprises a secondary optic placed in front of the optical element and a primary optic placed between the secondary optic and the secondary light sources;

according to the preceding paragraph, the optical element comprises the primary optic and the light guides, the primary optic and the light guides being produced as a single integral piece;

each primary light source is a light-emitting diode or LED.

Another subject of the invention is a motor-vehicle lighting device comprising a luminous module according to the invention.

The lighting device according to the invention may optionally have one or more of the following features:

the lighting device comprises a second luminous module arranged so as to generate a main lighting-beam segment; the luminous module according to the invention is arranged so as to generate a segment that is complementary to said main segment in order to form a lighting beam; the latter may be a high beam and/or a low beam; thus, the luminous module forming a pixelated light beam according to the invention is combined with the second luminous module in order to generate an adaptive lighting beam; said beam therefore integrates ADB and DBL functions, this allowing the comfort of use of the lighting device to be improved;

according to the preceding paragraph, the second luminous module generates a bottom low-beam portion, and the luminous module according to the invention is arranged so that it generates a light beam forming a top low-beam portion, in particular a dynamic bending light, that is turned on to complement the bottom portion of the low beam;

according to the preceding paragraph, the luminous module according to the invention is arranged so that it generates a light beam forming a distribution of a complementary high beam.

Unless otherwise indicated, the terms "front", "forward", "rear", "lower", "upper", "top", "higher", "bottom", "upward", "downward", "side", "transverse", "right" and "left", refer to the direction of emission of light from the corresponding luminous module. Unless otherwise indicated, the terms "upstream" and "downstream" refer to the direction of propagation of light in the object to which they relate.

Other features and advantages of the invention will become apparent on reading the detailed description of the following non-limiting examples, which description will be better understood with reference to the appended drawings, in which.

Figure 1:
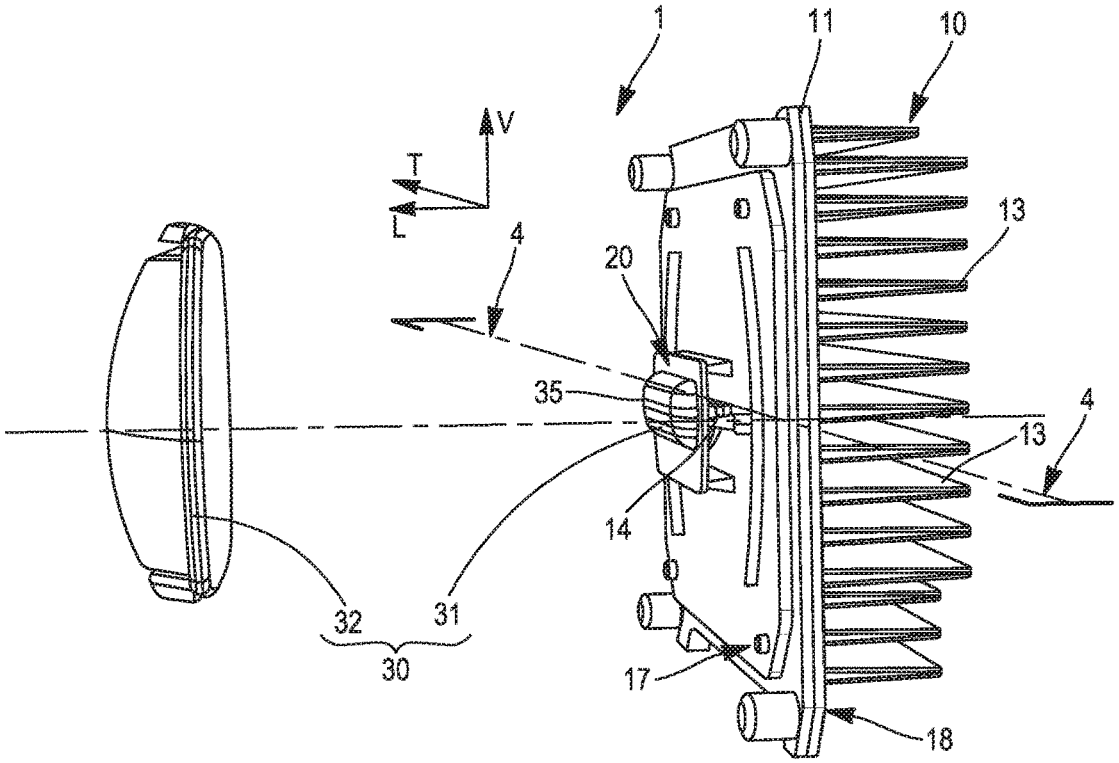
FIG. 1 illustrates a perspective view of a luminous module produced according to a first embodiment according to the invention.

With reference to FIG. 1, a luminous module 1 able to generate a light beam is illustrated. Here, the luminous module 1 emits the light beam longitudinally from rear to front, as illustrated by the arrow L in FIG. 1.

Said beam projects forward an image composed of a plurality of lighting zones, also called pixels, here, of rectangular shape and placed in at least one horizontal row.

The light beam generated by the luminous module 1 is, for example, turned on to complement a main lighting beam, such as a dipped beam or a high beam, in order to form a directional low beam (also called a bending light) or an adaptive high beam (also called an adaptive driving beam).

The luminous module 1 illustrated in FIG. 1 comprises light-emitting means 10, a projecting assembly 30 placed in front of said emitting means 10 and an optical element 20 placed between these two elements.

Here, the light-emitting means 10 are composed of a printed circuit board 11 or PCB and a plurality of light sources 14 that are here light-emitting diodes 14 or LEDs.

Figure 2:
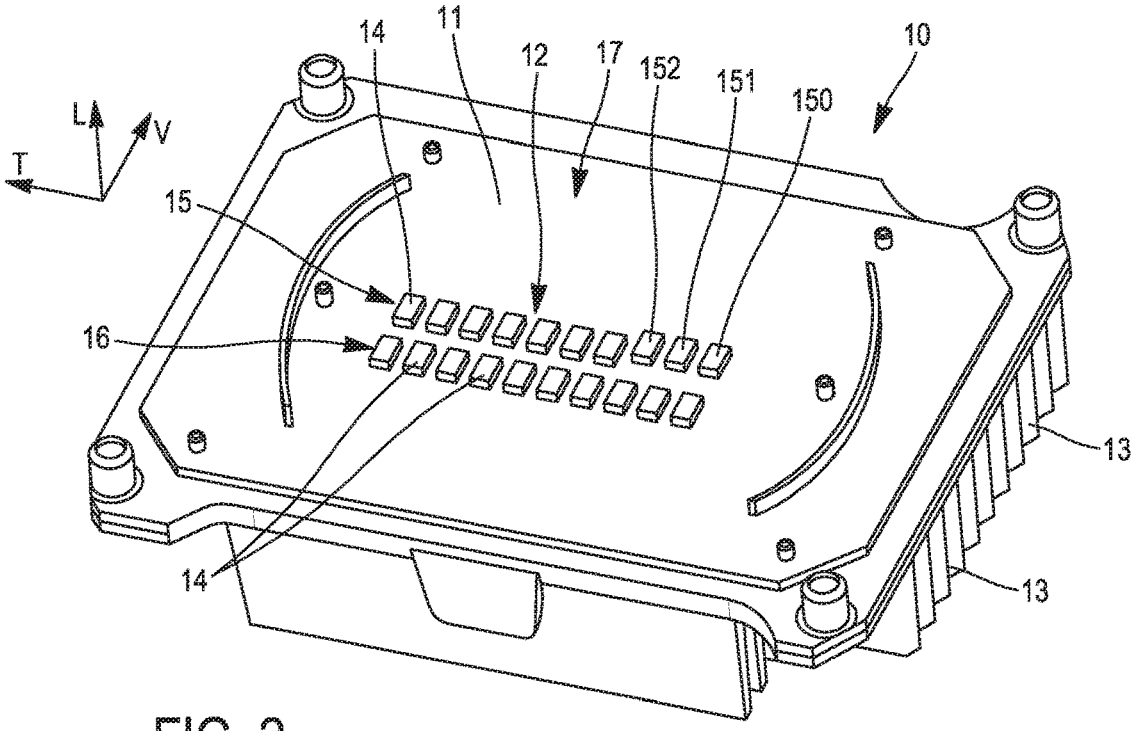
FIG. 2 illustrates a downstream perspective view of a carrier of a matrix array of light-emitting diodes.

In the presented example, the light-emitting diodes 14 are placed in two transverse rows, namely a first row 15 and a second row 16. Said rows are perpendicular to the direction of propagation of light in the luminous module 1. Each row 15 or 16 comprises ten separate light-emitting diodes 14 as illustrated in FIG. 2.

According to the invention and in this example, three of the ten light-emitting diodes of the first row are not aligned with other diodes in the same row. Here, the three non-aligned light-emitting diodes 150, 151 and 152 are those located to the right in FIG. 2. The reason for their offset with respect to the other diodes will be explained further on in the description.

Together, the two rows 15, 16 of light-emitting diodes 14 form a matrix array 12 of light sources. Said matrix array 12 is mounted on a front face 17 of the printed circuit board 11.

Furthermore, in order to evacuate the heat generated by the light sources 14, the printed circuit board 11 is mounted on a radiator the cooling fins 13 of which are installed on a rear face 18 of said board 11.

In other words, here, the radiator and the printed circuit board 11 form the carrier of the matrix array 12 of light sources.

Figure 3:
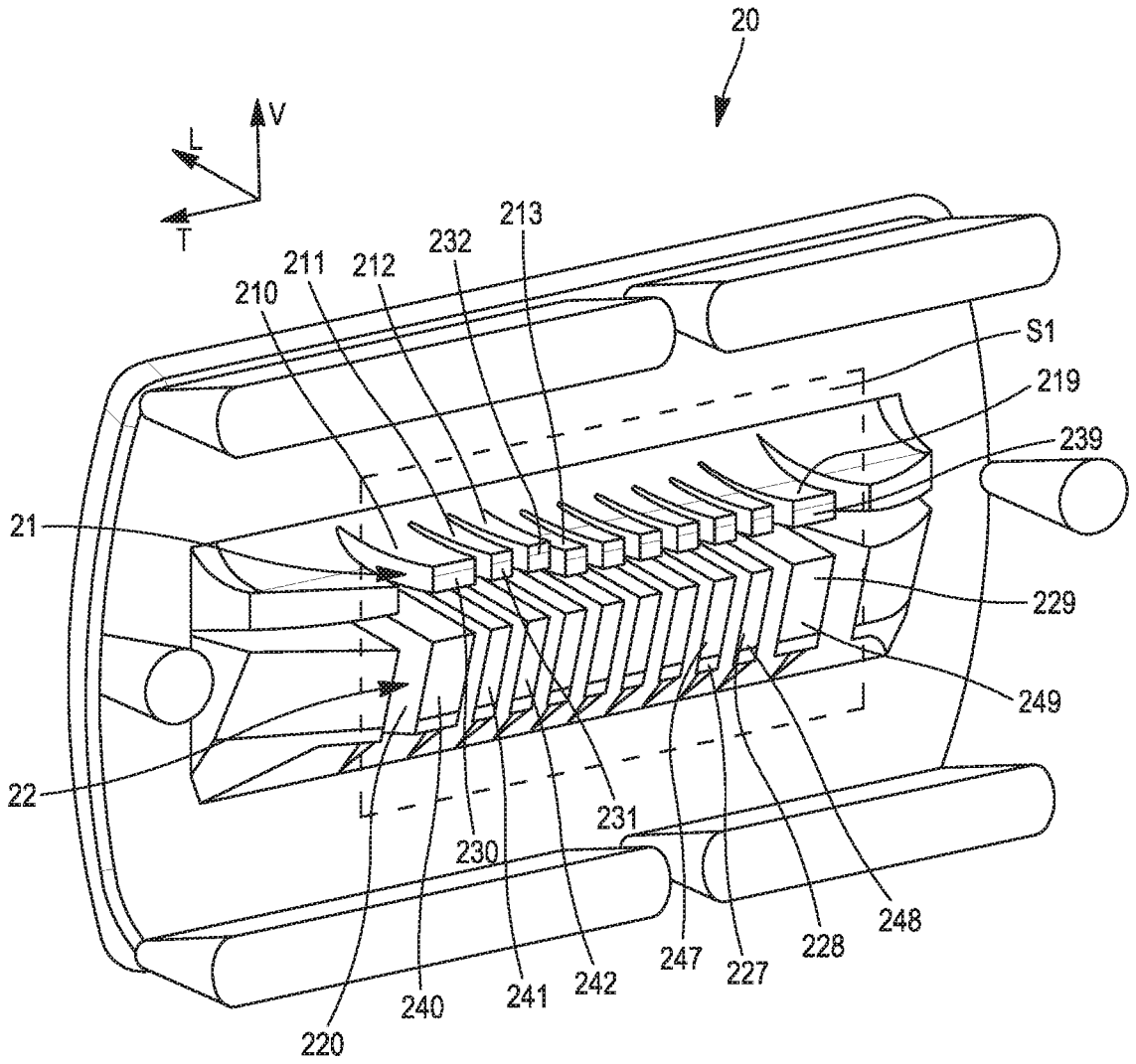
FIG. 3 illustrates an upstream perspective view that shows the rear of an optical element forming part of the luminous module of FIG. 1.

With reference to FIG. 3, the optical element 20 comprises an exit dioptric interface 35, an unapertured front segment 350 placed upstream of the exit dioptric interface 35, and a plurality of guides that are substantially parallel and separate from one another. The guides extend longitudinally rearward from the front segment 350, and in particular have an identical length.

In one variant embodiment, certain guides may be longer than others. For example, the exterior guides may be longer than the guides at the centre.

In the presented example, the optical element 20 comprises two rows of light guides, namely a top row 21 and a bottom row 22. Each row 21 or 22 contains ten light guides. The number of light guides per row corresponds to the number of light-emitting diodes 14 per row 15, 16 of the matrix array 12 of light sources.

The light guides of the top row 21 have been numbered, in order from left to right in FIG. 3, from 210 to 219 whereas the light guides of the bottom row have been numbered from 220 to 229 in the same order.

For the sake of clarity, only a few light guides have been referenced in FIG. 3.

Here, the light guides of a given row have the same height. In contrast, the guides located at the end of each row are wider than the other guides of the same row.

Moreover, the guides of the bottom row 22 have a cross section that is elongate in the vertical direction V. The obtained cross section of each bottom guide is longer than it is wide. In other words, the heightwise dimension of the guides of the bottom row 22 is larger than that of the top row 21.

As for the guides of the top row 21, with the exception of the guides at the ends 210 and 219, they have a substantially rectangular, and optionally square, cross section.

Apart from the geometric particularities described above, all the guides each comprise an entrance face and an exit.

Here, the entrance faces of the light guides may be seen in FIG. 3 and, in the illustrated example, form entrance dioptric interfaces.

The entrance faces of the light guides are arranged in a first plane S1 that is here parallel to the plane of the printed circuit board 11. When the optical element 20 is installed in the luminous module 1, each entrance face is placed facing one corresponding light-emitting diode 14 so that most of the light rays emitted by said diode 14 enter into the corresponding light guide.

Here, the entrance faces of the top row 21 are placed facing light-emitting diodes 14 of the first row 15. The entrance faces of the bottom row 22 are placed facing light-emitting diodes 14 of the second row 16.

The entrance faces of the light guides of the top row 21 have been numbered, in order from left to right in FIG. 3, from 230 to 239 whereas the entrance faces of the light guides of the bottom row 22 have been numbered from 240 to 249 in the same order.

For the sake of clarity, only a few entrance faces have been referenced in FIG. 3.

According to the invention and in this example, three light guides 210, 211 and 212 of the top row 21, numbered from the left in FIG. 3, are not aligned with the other guides of the same row. Said three guides 210, 211 and 212 are called the offset guides below whereas the other guides are called the non-offset guides.

As may be seen in FIG. 3, the offset of the light guides means that the entrance faces 230, 231 and 232 of the three offset guides 210, 211 and 212 are placed higher than the entrance faces 233 to 239 of the non-offset guides 213 to 219.

In this example, the heights of the entrance faces 230, 231 and 232 of the offset guides 230, 231 and 232 remain identical to the other guides. Here, the first offset guide 230, counted from the left in FIG. 3, which is also the guide located at the end of the top row 21, comprises a first entrance face 230 that has the same height as the tenth entrance face 239 located at the opposite end of the top row 21.

The second and third offset guides 211 and 212 comprise entrance faces of the same size as those of the non-offset guides, of course with the exception of the non-offset guide located at the right end of the top row 21.

To place the offset entrance faces 230, 231 and 232 with respect to the others, the associated light guides 210, 211 and 212 are positioned higher than the other guides. In other words, the guides 210, 211 and 212 are offset via an upward vertical translation.

Here, all the light guides from 220 to 229 of the bottom row 22 remain aligned with one another.

The optical element 20 is placed in front of the matrix array 12 of light sources so that the entrance face of each light guide is positioned facing an associated elementary light source 14 and so that the light beam emitted by each elementary light source 14 enters through the entrance face of the associated light guide, propagates through the latter, and exits via its exit.

In particular, the entrance faces 230, 231 and 232 of the offset guides 210, 211 and 212 are placed facing the non-aligned light-emitting diodes 150, 151 and 152 of the first row 15 of light-emitting diodes.

Specifically, by virtue of the offset of the non-aligned light-emitting diodes 150, 151 and 152, the entrance faces 230, 231 and 232 are located directly opposite said non-aligned diodes so that the main axis of light emission of these diodes passes through the symmetric centre of these entrance faces. Thus, the entrance faces 230, 231 and 232 collect most of the light rays emitted by the diodes 150, 151 and 152 for a better optical efficiency.

The exits of the light guides form secondary light sources 34. The latter are imaged by the projecting optic 30 in order to form a light beam.

In order to distinguish the light-emitting diodes 14 from the secondary light sources 34 formed by the exits of the light guides, the light-emitting diodes 14 borne by the printed circuit board are also called primary light sources 14.

Figure 4:
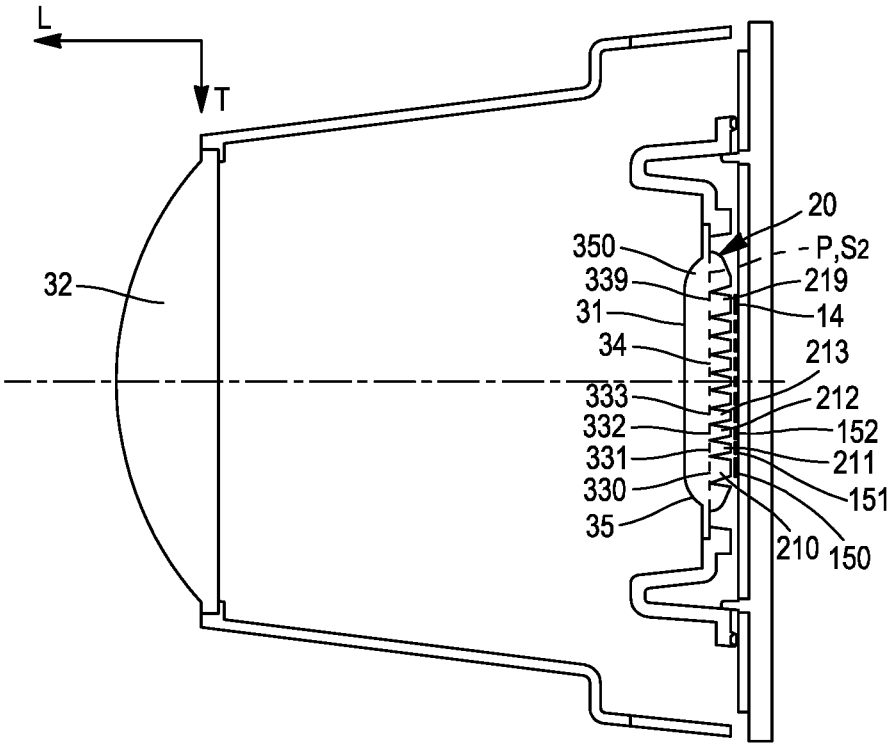
FIG. 4 illustrates a cross-sectional view in the horizontal cross-sectional plane 4-4 of FIG. 1; said view illustrating a plane in which the exits of the light guides of the optical element of FIG. 3 are located.

In FIG. 4, the exits of the light guides of the top row 21 may be seen. Despite the offset of the light guides of the top row 21 and of the light-emitting diodes of the first row 15, the cross-sectional plane 4-4 in FIG. 1 is placed so that all the light guides of the top row 21 and all the light-emitting diodes of the first row 15 are shown in FIG. 4.

The exits of the light guides of the top row 21 have been numbered, in order from bottom to top in FIG. 4, from 330 to 339.

For the sake of clarity, only a few exits have been referenced in FIG. 4. For example, the exits of the offset light guides 230, 231 and 232 have been numbered 330, 331 and 332, respectively.

In the same way as the entrance faces, the exits of the light guides are also placed in a second plane S2 parallel to the plane of the printed circuit board.

According to the invention and in this example, the projecting optic 30 and the light guides 210 to 219, 220 to 229 are arranged so that all the exits of the light guides are coplanar with the focal plane P of the projecting assembly 30. In other words, the second plane S2 in which all the exits 330 to 339 of the light guides 210 to 219 and 220 to 229 are located is coincident with the focal plane P of the projecting optic 30.

Thus, the image of the secondary light sources 34 is projected forward clearly and has a uniform light distribution.

Although the offset of the exits 330, 331 and 332 cannot be seen in the figures, it will be understood that, given the offset position of the three guides 210, 211 and 212, the corresponding exits 330, 331 and 332 of these guides are also offset vertically upward with respect to the other exits of the same row.

Of course, in another embodiment, the light guides may be designed so that only the exits are offset and not the entrance faces of the light guides.

To do this, it is enough to bend the chosen light guides from rear to front so that the bent guides comprise entrance faces aligned with those of the other guides and exit faces that are vertically offset upward or downward with respect to the exits of the other guides. Thus, in this configuration, the alignment of the light-emitting diodes 14 may be preserved.

According to the invention and in the illustrated example, the projecting assembly 30 comprises a secondary optic 32 placed in front of the light guides 210 to 219 and 220 to 229 and a primary optic 31 placed between the secondary optic 32 and the exits 330 to 339.

Here, the optical element 20 comprises not only the light guides 210 to 219 and 220 to 229 but also the primary optic 31. The primary optic 31 is placed in front of the exits 330 to 339 of the light guides. The primary optic 31 is formed by the exit dioptric interface 35 of the optical element 20.

In addition, the primary optic 31 and the light guides 210 to 219 and 220 to 229 may be produced as a single integral piece, as in the illustrated example.

The optical element 20, such as described, may be made of silicone. It may also be made of glass or of thermoformable plastic.

The primary optic 31 and the secondary optic 32 are optically coupled so as to form a system that is convergent on the focal plane P, which is coincident with the second plane S2 in which all the exits 330 to 339 of the light guides are located.

Optionally, a field-correcting lens may be interposed between the primary optic 31 and the secondary optic 32 so that the focal surface F of the projecting assembly is perfectly coplanar with the second plane S2, for example when it is difficult to produce with only the primary optic 31 and the secondary optic 32.

Thus, the projecting assembly 30, composed of the primary and secondary optics 32, images the secondary light sources 34.

The luminous module 1 described above may be used together with a second luminous module intended to generate a main lighting-beam segment.

For example, the second luminous module generates a bottom low-beam portion B1 whereas the luminous module 1 generates a light beam forming a top low-beam portion H1 and a complementary adaptive high beam.

Figure 5:
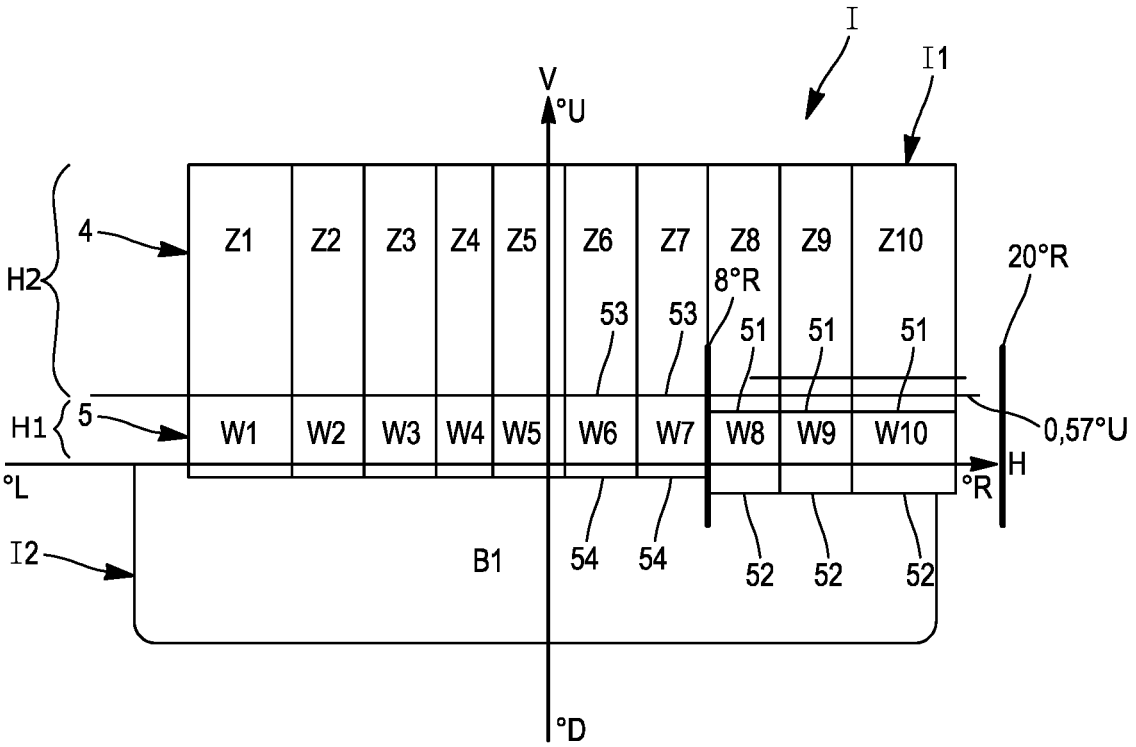
FIG. 5 illustrates the image of the light beam generated by the luminous module of FIG. 1, and the image of a bottom low-beam portion in an arrangement able to meet Regulation UNECE R123 applied in Europe.

When the beam generated by the assembly made up of the luminous module 1 and the second luminous module is projected onto a vertical screen located at a distance from the luminous module, for example at 25 metres, and directly opposite said assembly, a final image I such as illustrated in FIG. 5 is obtained.

The final image I is projected onto the screen in an orthogonal coordinate system R composed of a vertical axis V by way of ordinate and a horizontal axis H by way of abscissa. The vertical axis V corresponds to a vertical axis above the road and the horizontal axis H symbolizes the horizon.

The angular positions of the final image I in the coordinate system R are expressed:

[1] in degrees up (° U) for everything that is above the horizontal axis H;

[2] in degrees down (° D), for everything that is below the horizontal axis H;

[3] in degrees left (° L), for everything that is to the left of the vertical axis V; and

[4] in degrees right (° R), for everything that is to the right of the vertical axis V.

It will be noted that the illustrated example relates to right-hand traffic. For left-hand traffic, the module and beam need merely be the symmetric about a vertical plane extending from upstream to downstream.

Here, the final image I is composed of an image I1 of the secondary light sources and an image 12 of the bottom low-beam portion B1.

It will be noted that the image I1 of the secondary light sources 34 is inverted in this example embodiment of the luminous module. Specifically, the light beams output from the top row 21 of light guides are projected downward whereas those of the bottom row 22 of light guides are projected upward.

Each elementary secondary light source 34 illuminates a zone of the screen. In other words, each of the zones Z1 to Z10 and W1 to W10 therefore corresponds to the exits of the light guides of the optical element 20.

The zones on the screen Z1 to Z10 and W1 to W10 are also called pixels.

The pixels Z1 to Z10 and W1 to W10 on the screen are placed in two horizontal rows, an upper row 4 and a lower row 5.

The upper row 4 of pixels forms a distribution of a complementary high beam. It contains the pixels Z1 to Z10 that respectively correspond to the exits of the bottom row 22 of the optical element 20, and therefore to the light sources of the second row 16.

More precisely, the pixel Z1 corresponds to the projected image of the exit of the light guide 229 located at the right end of the bottom row 22 in FIG. 3. The pixel Z2 corresponds to the exit 248 of the light guide 228 located to the left of the guide 229 at the right end. The pixel Z3 corresponds to the exit 247 of the guide 227 located to the left of the guide 228 and so on up to pixel Z10. The pixel Z10 corresponds to the exit 240 of the light guide 220 that is located leftmost in the bottom row 22 of FIG. 3.

The shape of each of these pixels is defined by peripheral edges of the exit of the associated light guide.

Here, for each of the light guides, the entrance face remains similar in shape but not in size to the exit. Thus, the pixels Z1 to Z10 of the upper row 4 have an identical shape to that of the exits 240 to 249 of the bottom row 22. Here, the pixels Z1 to Z10 are rectangles of greater height than width.

In the same way as the exits, the zones Z1 and Z10 are wider than the zones Z2 to Z9.

The lower row 5 of pixels forms a top segment of a low beam. In this example, it forms a dynamic bending light. In the lower row 5 of pixels, the correspondence between the pixels W1 to W10 and the exits of the top row 21 is similar to the correspondence between the pixels Z1 to Z10 and the bottom row 22.

In particular, the last three pixels W8 to W10 correspond to the projected images of the exits 330, 331 and 332 of the three offset guides 210, 211 and 212 described above, respectively.

In the illustrated example, the three pixels W8 to W10 are offset vertically downward with respect to the other pixels W1 to W7 of the same row.

Generally, the offset of the three pixels W8 to W10 is limited along the vertical in order to preserve a rectilinear illumination of the roadside. For example, for optimal illumination of the roadside this offset is only 1° downward, here 1° under the segment BRR.

For each of these three offset pixels W8 to W10, the upper edge 51 and the lower edge 52 of the pixel in question are offset vertically downward with respect to the upper edge 53 and to the lower edge 54 of the non-offset pixels W1 to W7, respectively.

By controlling each elementary primary light source 14 individually, here each light-emitting diode 14, it is possible to selectively turn on each of the pixels W1 to W10 and Z1 to Z10 so as to perform an adaptive function with the main lighting beam, and in particular a DBL function using pixels W1 to W10 and an ADB function using pixels Z1 to Z 10 in combination with pixels W1 to W10.

It is possible for the lower row 5 of pixels and the bottom portion B1 of the low beam to straddle one another to an extent, in particular in order to ensure a gentle transition between these two elements.

The pixels are placed so that the photometric distribution meets the conditions set by Regulation UNECE R123.

In this example, the three offset pixels W8 to W10 are located below the segment BRR, which is at 0.57° U and between 8° R and 20° R. Thus, when these three offset pixels W8 to W10 are turned on, they have no impact on the light intensity of the segment BRR. Therefore, the light intensity measured in the segment BRR runs no risk of exceeding the value of 3550 cd as required by the regulation.

In an application to a low beam, the light-emitting diodes 14 are controlled so that the pixels Z1 to Z10 of the upper row 4 are turned off. In contrast, the pixels W1 to W10 of the lower row 5 may be selectively turned on with the bottom low-beam portion B1 in order to produce an adaptive final low beam integrating a DBL function.

When a vehicle is being driven in a straight line, the pixels W1 to W5, which are mainly located to the left of the vertical axis V, are turned off whereas the pixels W6 to W10, which are mainly located to the right of the vertical axis V, are turned on so as to form a top cut-off line of the low beam. Given that the zones W8 to W10 are offset, the light intensity in the segment BRR meets the regulations in force.

For a right-hand bend, pixels W8 to W10, or indeed even pixels W7 to W10, are gradually turned on from left to right, until the end of the bend, here the pixel W10 located rightmost in the row when the bend is very pronounced.

For a left-hand bend, pixels W1 to W5, which are located to the left of the vertical axis V, are gradually turned on from right to left, i.e. from the pixel W5 toward the pixel W1, or even to pixel W1 when the bend is very pronounced, this allowing a better illumination of the side to the left of the driver.

Therefore, the luminous module 1 of the luminous system according to the invention generates an adaptive low beam that allows the generated illumination to provide better visibility during cornering and that meets the conditions set by regulations.

In another example application, for example to an adaptive high beam, the light-emitting diodes 14 are controlled so that all the pixels Z1 to Z10 and W1 to W10 are turned on, in particular when there is no vehicle being driven in front.

When the vehicle detects other vehicles either in front or being driven in the opposite direction, the light-emitting diodes 14 are controlled so as to create a dark zone in the location of the detected user. For example, to do this, pixels W3 and W4 of the lower row 5 of pixels and pixels Z3 and Z4 of the upper row 4 of pixels are turned off.

The pixels Z1 to Z10 then form an adaptive complementary high beam. They are turned on in order to form a light beam located above the dynamic bending light formed by pixels W1 to W10, which light is itself located above a bottom portion B1 of a low beam.

According to one variant embodiment, the principle of the offset of a few pixels in a row of pixels may be applied to the upper row 4 of pixels, which is illustrated in FIG. 5.

By way of example, in the case where photometric measurement of the pixelated light beam H1 indicates that the bottom zone of the pixels is too bright in the high beam, it is possible to offset at least one of the pixels Z1 to Z10 of the upper row 4 of pixels vertically upward.

To do this, the one or more guides that participate in generating the one or more pixels offset in this upper row 4 have their exit offset vertically downward with respect to the other exits of the other guides. Here, the guides to be offset upward form part of the guides 220 to 229 of the bottom row 22 of the optical element 20.

Of course, the luminous system and the luminous module according to the invention may be configured so as to generate a light beam that meets other regulations, for example Federal Motor Vehicle Safety Standards (FMVSS).

In these standards, the glare to which drivers of oncoming vehicles are subjected is measured and compared to thresholds established on the basis of standard FMVSS 108.

Figure 6:
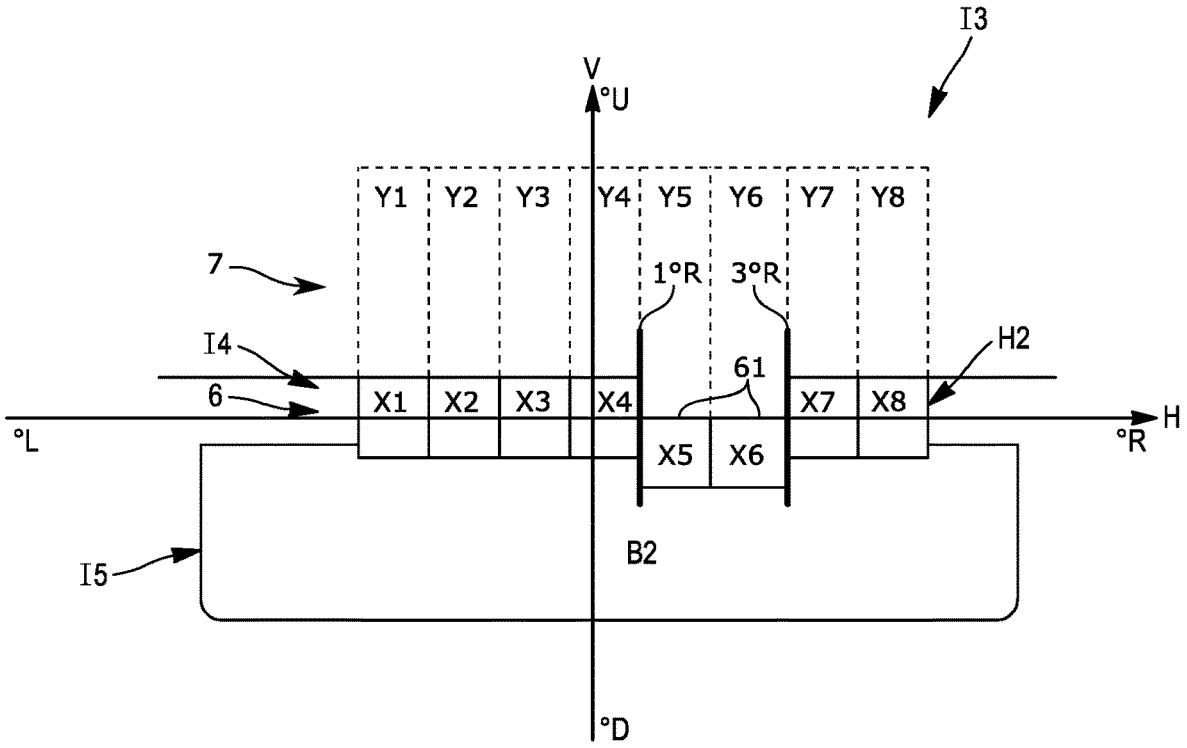
FIG. 6 illustrates the image of a light beam generated by a luminous module produced according to a second embodiment of the invention, and the image of a bottom low-beam portion in an arrangement able to meet standard FMVSS 108 applied in the United States.

With reference to FIG. 6, a final image 13 of a light beam that may be adapted to standard FMVSS 108 is illustrated. To use the terminology of this standard, the light beam, which beam may be a low beam, is in a "VOR beam pattern" configuration for left-hand traffic.

The final image 13 is shown in a coordinate system R identical to the coordinate system presented with reference to FIG. 5.

The low beam is composed of a bottom low-beam portion B2 and a top low-beam portion H2. The top low-beam portion is generated by a luminous module produced according to a second embodiment of the invention whereas the bottom low-beam portion B2 is generated by a second luminous module known to those skilled in the art.

The image 14 of the top low-beam portion comprises a single row 6 of eight pixels X1 to X8 which are arranged so that the photometric distribution meets the conditions set for a low beam by the regulations of the United States.

In particular, two pixels X5 and X6 are vertically offset downward with respect to the other pixels in order to meet a condition of the latest version in force, dated July 2018, of standard FMVSS 108.

Specifically, this condition states that there must be no light above the horizon between 1° R and 3° R for a beam in a "VOR beam pattern" configuration. As illustrated in FIG. 6, the two offset pixels X5 and X6 are the pixels that would otherwise cross the straight line located between 1° R et 3° R and at 0° U if the pixels were all aligned.

By virtue of the invention, the two pixels X5 and X6 are offset vertically downward so that the upper ends 61 of said pixels X5 the X6 are superposed with the straight line located between 1° R et 3° R and at 0° U. In this way, there is no light above the horizon between 1° R and 3° R.

The luminous module bearing the optical part that participates in generating the image 13 therefore meets standard FMVSS 108.

Furthermore, such a luminous module has a high chance of obtaining a good rating during a safety evaluation carried out by the Insurance Institute for Highway Safety (IIHS). Specifically, apart from the offset pixels X5 and X6, the other, non-offset pixels X1 to X4 and X7 and X8 straddle the horizontal axis H at 0° U. Thus, when these non-offset pixels are turned on, the range of the light beam is improved outside of the zones in which there is a risk of glare and in which standard FMVSS 108 recommends not illuminating above the horizon.

This allows the distance at which the light flux of the beam reaches a value of 5 lux to be increased. The larger this distance, the better the visibility generated by the luminous module and therefore the higher the rating of said module according to the criteria of the IIHS safety evaluation.

Thus, the luminous module according to the invention, and in particular according to this embodiment, generates good visibility while meeting the regulation in order to avoid subjecting an oncoming driver to glare.

To generate the image 13 illustrated in FIG. 6, an optical element is therefore used, as in the preceding embodiment. The optical element is adapted so as to comprise a single row of light guides composed of eight separate guides. The guides that participate in generating the offset pixels X5 and X6 each comprise an exit offset vertically upward with respect to the exits of the other guides.

In one variant embodiment, an upper row 7 of pixels Y1 to Y8 (shown by the dashed lines) is located above the row 6 of pixels X1 to X8. This upper row 7 of pixels Y1 to Y8 allows an adaptive complementary high beam to be formed.

To generate this upper row, an optical element is therefore used, as in the preceding embodiment. The optical element may be adapted so as to comprise the desired number of guides to form the desired number of pixels in each of the rows. The guides that participate in generating the offset pixels X5 and X6 each comprise an exit offset vertically upward with respect to the exits of the other guides.

The invention claimed is:

1. A luminous motor-vehicle module that generates a light beam that projects forward an image, the image comprising at least one horizontal row of pixels, wherein the at least one horizontal row of pixels includes one horizontal row of pixels that comprises a first row of plural pixels and a second row of plural pixels, each one of the pixels of the first row has the same non-zero offset relative to each one of the pixels of the second row, the luminous module is arranged so that a first pixel of the first row of pixels comprises a lower end and/or an upper end that are/is vertically offset with respect to a lower end and/or an upper end of a second pixel of the second row, respectively, and the first horizontal row of pixels forms a top segment of a low beam, wherein the first pixel comprises an upper end that is offset downward with respect to an upper end of the second pixel, and the first pixel comprises a lower end that is offset downward with respect to a lower end of the second pixel, wherein the luminous module comprises:

a plurality of primary light sources;

an optical element placed downstream of the primary light sources; the optical element comprising a plurality of light guides, each light guide comprising an entrance face placed facing an associated primary light source and an exit surface, the exit surfaces of the light guides forming secondary light emission surfaces, and a projecting assembly placed downstream of the light guides so as to project forward the image of the secondary light emission surfaces, and wherein the optical element comprises a first light guide that participates in the generation of the first pixel, and a second light guide that participates in the generation of the second pixel, the first guide and second guide each comprising an exit, the first exit and the second exit, respectively, the first exit comprising a lower and/or upper edge that are/is offset vertically with respect to a lower and/or upper edge of the second exit, respectively.

2. The luminous module according to claim 1, wherein the first pixel has a height smaller than the height of the second pixel.

3. The luminous module according to claim 1, wherein the first pixel is located below a horizontal line located at 0.57° above a horizontal line (0.57° U) and the second pixel straddles the horizontal line located at 0.57° U.

4. The luminous module according to claim 1, wherein the first pixel comprises an upper end located at the same level or below a horizontal axis (0° U) and the second pixel straddles the horizontal axis.

5. The luminous module according to claim 1, wherein the image comprises at least one second horizontal row of pixels, the row, which is called the upper horizontal row, being placed above the first horizontal row of pixels.

6. The luminous module according to claim 5, wherein the upper horizontal row of pixels forms a distribution of an adaptive complementary high beam.

7. The luminous module according to claim 1, wherein the optical element and the projecting assembly are arranged so that the exit of each light guide is coplanar with a focal plane of the projecting assembly.

8. The luminous module according to claim 1, wherein the projecting assembly comprises a secondary optic placed in front of the optical element and a primary optic placed between the secondary optic and the secondary light emission surfaces.

9. The luminous module according to claim 8, wherein the optical element comprises the primary optic and the light guides, the primary optic and the light guides being produced as a single integral piece.

10. A motor-vehicle lighting device, that comprises a luminous module according to claim 1.

11. The motor-vehicle lighting device according to claim 10, further comprising a second luminous module arranged so as to generate a main lighting-beam segment, and the luminous module is arranged so as to generate a segment that is complementary to the main segment in order to form a lighting beam.

12. The motor-vehicle lighting device according to claim 11, wherein the second luminous module generates a bottom low-beam portion and the luminous module is arranged so that it generates a light beam forming a top low-beam portion that is turned on to complement the bottom portion of the low beam.

13. The luminous module according to claim 1, wherein the first pixel has a height smaller than the height of the second pixel.

14. The luminous module according to claim 1, wherein the first pixel is located below a horizontal line located at 0.57° above a horizontal line (0.57° U) and the second pixel straddles the horizontal line located at 0.57° U.

15. The luminous module according to claim 1 wherein the first pixel comprises an upper end located at the same level or below a horizontal axis (0° U) and the second pixel straddles the horizontal axis.

16. The luminous module according to claim 1 wherein the image comprises at least one second horizontal row of pixels, the row, which is called the upper horizontal row, being placed above the first horizontal row of pixels.

* * * * *